US007121459B2

(12) United States Patent
Holland-Letz

(10) Patent No.: US 7,121,459 B2
(45) Date of Patent: Oct. 17, 2006

(54) DEVICE FOR TRANSPORTING BANKNOTES IN A CASH DISPENSER

(75) Inventor: Guenter Holland-Letz, Paderborn (DE)

(73) Assignee: Wincor Nixdorf International GmbH, Paderborn (DE)

( * ) Notice: Subject to any disclaimer, the term of this patent is extended or adjusted under 35 U.S.C. 154(b) by 493 days.

(21) Appl. No.: 10/466,701

(22) PCT Filed: Dec. 4, 2001

(86) PCT No.: PCT/DE01/04551

§ 371 (c)(1),
(2), (4) Date: Jul. 18, 2001

(87) PCT Pub. No.: WO02/059843

PCT Pub. Date: Aug. 1, 2002

(65) Prior Publication Data

US 2006/0071064 A1 Apr. 6, 2006

(30) Foreign Application Priority Data

Jan. 24, 2001 (DE) ..... 101 03 120

(51) Int. Cl.
*G07F 19/00* (2006.01)

(52) U.S. Cl. ..... 235/379

(58) Field of Classification Search ..... 235/379; 209/534

See application file for complete search history.

(56) References Cited

U.S. PATENT DOCUMENTS 2,811,232 A * 10/1957 Seidel ..... 192/44
4,566,684 A * 1/1986 Gysling ..... 271/117
4,747,493 A 5/1988 Nakanishi
4,813,658 A * 3/1989 Hosking et al. ..... 271/10.04
4,891,502 A 1/1990 Motoi et al.

FOREIGN PATENT DOCUMENTS

EP 0 174 009 A2 3/1986
EP 0 535 543 A2 4/1993

* cited by examiner

*Primary Examiner*—Thien M. Le
*Assistant Examiner*—Kristy A. Haupt
(74) *Attorney, Agent, or Firm*—Michaud-Duffy Group LLP

(57) ABSTRACT

In the case of an apparatus for transporting banknotes, within an automated teller machine, between at least one banknote cassette, for storing banknotes which are to be dispensed, and a dispensing location or between the latter and a receiving container for banknotes which have been drawn back, comprising a bundle-transporting section which is located between the dispensing location and a collecting location, at which banknotes which have been removed individually from the banknote cassette are collected into a bundle, and has two belt drives, a bundle of banknotes being gripped, and transported, between the mutually parallel endless belts of the belt drives, said endless belts circulating in the same direction in each case over a drive roller, and also has a drive arrangement for driving the belt drives, characterized in that the belt drives can be driven at different speeds at least in the direction from the dispensing location to the receiving container.

10 Claims, 5 Drawing Sheets

DEVICE FOR TRANSPORTING BANKNOTES IN A CASH DISPENSER

CROSS-REFERENCE TO RELATED APPLICATIONS

This application is entitled to the benefit of and incorporates by reference essential subject matter disclosed in International Application No. PCT/DE01/04551 filed on Dec. 4, 2001 and German Patent Application No. 10103120.3 filed on Jan. 24, 2001.

FIELD OF THE INVENTION

The invention relates to an apparatus for transporting banknotes, within an automated teller machine, between at least one banknote cassette, for storing banknotes which are to be dispensed, and a dispensing location or between the latter and a receiving container for banknotes which have been drawn back, comprising a bundle-transporting section which is located between the dispensing location and a collecting location, at which banknotes which have been removed individually from the banknote cassette are collected into a bundle, and has two belt drives, a bundle of banknotes being gripped, and transported, between the mutually parallel endless belts of the belt drives, said endless belts circulating in the same direction in each case over a drive roller, and also has a drive arrangement for driving the belt drives.

BACKGROUND OF THE INVENTION

It is usually by means of the bundle conveyor or dispensing conveyor that the bundle of banknotes, bundled in the collecting location, is transported with aligned edges to the dispensing location, where it can be removed by the customer. In special cases, however, the bundle of banknotes has to be conveyed back again from the dispensing opening to a so-called reject cassette if the customer, for example, has forgotten to remove the money or if an incorrect number of notes has been established before the bundle of banknotes is dispensed. It is also necessary here, if appropriate, for relatively thick bundles of stiff banknotes to be deflected, via a diverter, over a narrow radius into the reject cassette. The opening in the reject cassette has to be capable of being reliably closed, in order to be transported, and is relatively narrow on account of the compressed construction of the reject cassette. Moreover, the drawing-in rollers have a small diameter on account of the compressed construction of the reject cassette, with the result that they can only draw in a bundle of limited thickness. Problems thus arise if a bundle of banknotes which form a stiff block is to be deflected in narrow space conditions and drawn into the reject cassette.

The object of the invention is to design an apparatus of the type mentioned in the introduction such that even relatively thick and stiff bundles of banknotes can easily be drawn into the reject cassette through a narrow opening.

SUMMARY OF THE INVENTION

This object is achieved according to the invention in that the belt drives can be driven at different speeds at least in the direction from the dispensing location to the receiving container.

If the two belt drives, which interact in order to transport the bundle of banknotes, are driven at different speeds in the manner proposed according to the invention, then the bundle of banknotes if fanned out. That is to say, whereas, during transportation of the banknotes to the dispensing location, the two belt drives run at exactly the same speed, in order for the banknotes to be supplied to the customer in an edge-aligned bundle in the dispensing compartment, the bundle is fanned out as it is transported back, as a result of which it becomes thinner and considerably more flexible and can easily be bent around relatively small radii. The fanning-out may be enhanced as desired over a given length by the bundle being moved back and forth a number of times.

Different drive speeds of the two belt drives can be achieved in that the drive arrangement, for each belt drive, has a dedicated motor, of which at least one can be controlled in terms of speed.

It is also possible, however, for the drive arrangement, as has been the case up until now, to manage with one motor, in that one of the two belt drives can be coupled to the motor in one transporting direction via a first gear train and in the other transporting direction via a second gear train with a different transmission from the first gear train.

In the case of one practical embodiment of this solution, the drive roller of a first belt drive and a parallel intermediate shaft are coupled in a rotationally fixed manner to the motor, while the drive roller of the second belt drive is in torque-transmitting connection with the first drive roller via a first one-way clutch and with the intermediate shaft via a second one-way clutch, of which the direction of action is oriented counter to that first one-way clutch. The one-way clutches may be configured in different ways. For example, it is possible for one of the one-way clutches to be a latching freewheel or clamping-body freewheel and for the other one-way clutch to be a slip clutch which, in one direction, allows torque transmission and, in the other direction, prevents blocking of the gear mechanism if there is contact between two gear elements at different rotational speeds. The act of the differential speed being taken up by a slip clutch, however, obviously subjects the drive motor to loading. If this is not desirable, it is also possible for the one-way clutches to be formed by vibratory-spring clutches which act in different directions. The vibratory-spring clutches tighten in the respective direction of rotation on the shaft on which they are seated or wind up in order to interrupt the torque transmission. The vibratory springs are usually controlled via a friction clutch with a low torque.

The bundle-transporting section can easily be coupled to a further transporting section comprising two belt drives, an endless belt of one belt drive being guided over the first drive roller and the endless belt of the second belt drive being guided over a drive roller which is seated on the intermediate shaft. Since the first drive roller and the intermediate shaft are always driven at the same rotational speed, it is also the case that the two belt drives of this second transporting section run at the same speed, with the result that, on this second transporting section, the bundle of banknotes is always transported in the form in which it has passed into the second transporting section, that is to say either with the edges of the banknotes aligned or in fanned-out form. The second transporting section can connect the bundle-transporting section to the collecting location and, via a diverter, to the receiving container.

BRIEF DESCRIPTION OF THE DRAWINGS

Further features and advantages of the invention can be gathered from the following description, which explains the invention, with reference to an exemplary embodiment, in conjunction with the attached drawings, in which.

DETAILED DESCRIPTION OF THE PREFERRED EMBODIMENTS

Figure 1:
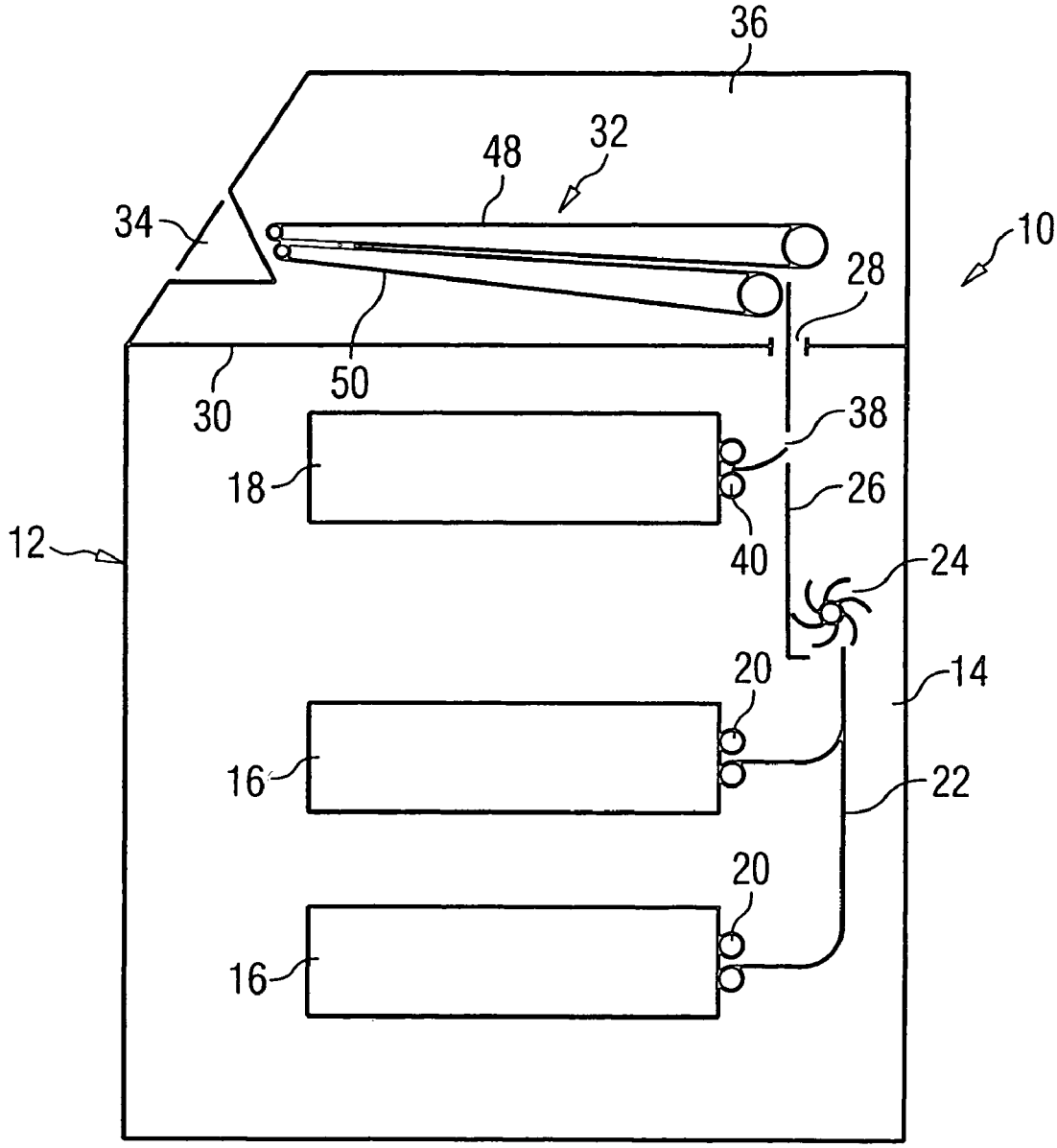
FIG. 1 shows a schematic side view of an automatic teller machine.

FIG. 1 shows an automatic teller machine 10, which is illustrated in a highly schematic and simplified form, with a housing 12. Located in the bottom part of the housing, which is designed as a safe 14, are two banknote cassettes 16, for accommodating banknotes which are to be dispensed, and a reject cassette 18, for accommodating banknotes which, although supplied for dispensing purposes, have not, for whatever reason, reached the customer. Each banknote cassette 16 is assigned a separating mechanism 20, in order for the banknotes to be withdrawn separately from the banknote cassette 16 and fed to a collecting conveyor 22 which extends in the vertical direction past the banknote cassettes 16 and goes as far as a collecting location 24, where the banknotes which have been withdrawn individually from the banknote cassettes 16 are collected into a bundle. The resulting bundle of banknotes is then received by a further vertical transporting section 26, which conveys the bundle, through an opening 28 in the top surface 30 of the safe 14, to a dispensing conveyor 32, which then transports the bundle of banknotes as far as a dispensing compartment 34 in the operating unit 36 of the automated teller machine 10.

If the customer does not remove the bundle of banknotes supplied from the dispensing compartment 34, or if it is established, before the bundle of banknotes is dispensed, that the values of the banknotes in the bundle are not correct or the number of banknotes in the bundle is incorrect, the bundle of banknotes is transported back again by the dispensing conveyor 32, transferred to the vertical conveyor 26 and transported by the latter, via a diverter 38, to the reject cassette 18, which is assigned a drawing-in mechanism 40 in order for the bundle of banknotes to be pushed into the reject cassette 18.

As has been explained in the introduction, it is difficult for the compact bundle of banknotes, which, in particular in the case of relatively new, stiff banknotes, behaves like a stiff block with little flexibility, to be deflected around relatively small radii in the diverter and drawn in through the narrow opening of the reject cassette 18. The bundle of banknotes is thus fanned out as it is transported back in the dispensing conveyor 32. A design of the dispensing conveyor 32 which is suitable for this purpose will now be explained in more detail hereinbelow with reference to FIGS. 2 to 5.

The dispensing conveyor 32 has a bearing frame 42 with two frame walls 44, 46 which are parallel to one another. A top belt drive 48 and a bottom belt drive 50 are arranged between the frame walls 44 and 46. The top belt drive 48 comprises two endless belts 52, which each run over a roller 54, which is seated in a rotationally fixed manner on a drive shaft 56 mounted in the frame walls 44 and 46, and a roller 58, which is mounted in a freely rotatable manner on a shaft 60 mounted in the frame walls 44 and 46.

The bottom belt drive 50 comprises two endless belts 62, which each run over a roller 64, which is seated in a rotationally fixed manner on a drive shaft 66 mounted in the frame walls 44 and 46, and a roller 68, which is mounted in a freely rotatable manner on a shaft 70 mounted in the frame walls 44 and 46. The bottom strands of the endless belt 62 of the top belt drive 48 interact with the top strands of the endless belts 62 of the bottom belt drive 50 in order to transport a bundle of banknotes, as can be seen in FIGS. 4 and 5.

Arranged in a rotationally fixed manner on the drive shaft 66, coaxially with the rollers 64, are two further rollers 72, over which in each case one endless belt 74 runs. The two endless belts 74 form a belt drive of the banknote-transporting section 26 and interact with a further belt drive, that is to say two further endless belts 76 each running over a top deflecting roller 78, these, for their part, being seated in a rotationally fixed manner in each case on an intermediate shaft 80 mounted in the frame walls 44 and 46. As can be seen by comparing FIGS. 2 and 3, on the one hand, and FIGS. 4 and 5, on the other hand, the banknotes guided between the endless belts 74 and 76 are transferred to the belt drive 48 and 50. It is likewise possible for transfer to take place in the opposite direction.

Figure 4:
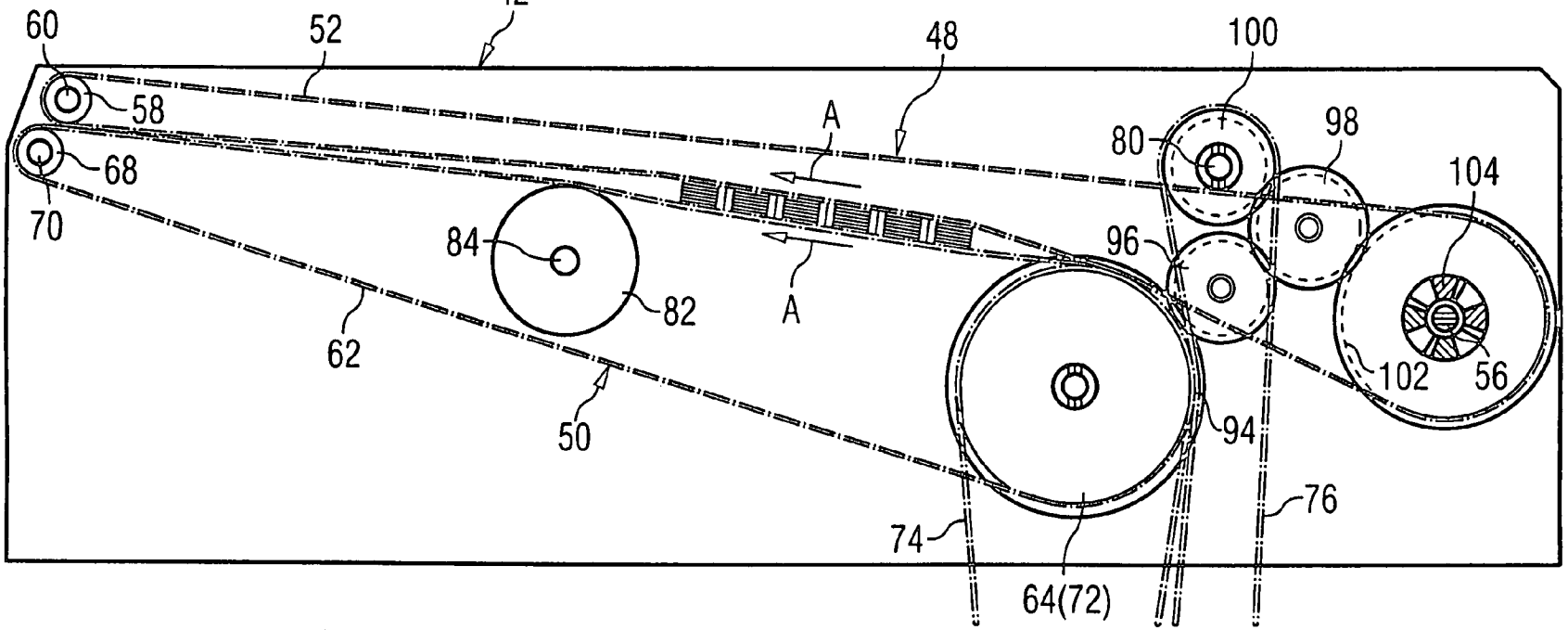
FIG. 4 shows a schematic side view of the transporting unit illustrated in FIG. 2, taken along line IV—IV in FIG. 2, for the purpose of explaining a first gear train.
Figure 5:
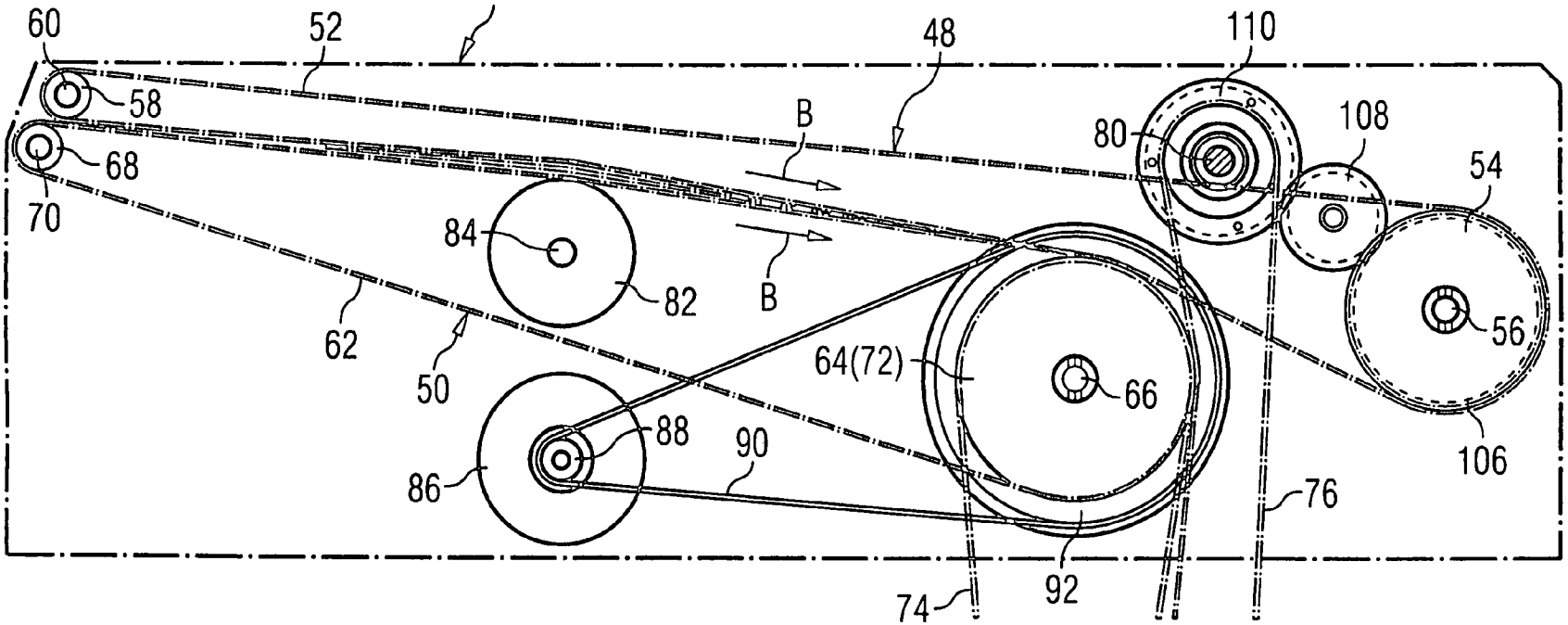
FIG. 5 shows a schematic section along line V—V in FIG. 3, for the purpose of explaining the other gear train.

In order to avoid sagging of the endless 52 and 62 of the horizontal dispensing conveyor, the top strands of the endless belts 62 of the bottom belt drive 50 run over a supporting roller or supporting rollers 82, which are likewise seated on a shaft 84 mounted in the frame walls 44 and 46, as FIGS. 4 and 5 show.

The belt drives of the dispensing conveyor 32 and of the vertical conveyor 26 are driven via a motor 86, which is arranged on the inside of the frame wall 44 and of which the drive wheel 88, which is located on the outside of the frame wall 44, drives, via a driving belt 90, a driving wheel 92 which is seated in a rotationally fixed manner on the drive shaft 66. That end of the drive shaft 66 which is opposite to the driving wheel 92, and projects out of the frame wall 46, bears a first gearwheel 94. The latter engages with a first intermediate gearwheel 96, which is mounted on the frame wall 46 and, for its part, drives a second intermediate gearwheel 98 mounted on the frame wall 46. The intermediate gearwheel 98, for its part, engages with a second gearwheel 100, which is connected in a rotationally fixed manner to the intermediate shaft 80, and also with a third gearwheel 102, which can be coupled to the drive shaft 56 via a first one-way clutch 104 in the form of a latching freewheel.

Seated in a rotationally fixed manner on an end of the drive shaft 56 which projects beyond the frame wall 44 is a fourth gearwheel 106, which, via a third intermediate gearwheel 108 mounted on the frame wall 44, drives a fifth gearwheel 110, which can be coupled to the intermediate shaft 80 via a second one-way clutch 112, which is designed as a slip clutch. The slip clutch comprises a brake disk 114 which is connected in a rotationally fixed manner to the intermediate shaft 80 and against which the gearwheel 110, which bears a brake lining 116, is braced by a helical compression spring 118.

The above description shows that the drive shaft 66 of the bottom belt drive 50 and the intermediate shaft 80 are driven, via the intermediate gearwheels 96 and 98, in the two directions of rotation together at the rotational speed determined by the speed of the motor and the transmission ratios. The drive shaft 56 of the top drive belt 48, in contrast, is driven in one direction of rotation, in which the latching clutch 104 engages and can thus transmit a torque from the gearwheel 102 to the drive shaft 56, via the gear train formed the gearwheel 94, the intermediate gearwheels 96 and 98, the gearwheel 102 and the one-way clutch 104. If there is a difference here between the rotational speed of the intermediate shaft 80 and the gearwheel 110, this being driven, via the intermediate gearwheel 108, by the gearwheel 106 seated on the drive shaft 56, then this difference is taken up by the slip clutch 112.

In the opposite direction of rotation, in which the one-way clutch 104 does not engage and thus no torque can be transmitted from the gearwheel 102 to the drive shaft 56, the drive shaft 56 is driven via the gear train formed by the gearwheel 94, the intermediate gearwheels 96 and 98, the gearwheel 100, the intermediate shaft 80, the slip clutch 112, the gearwheel 110, the intermediate gearwheel 108 and the gearwheel 106.

Figure 2:
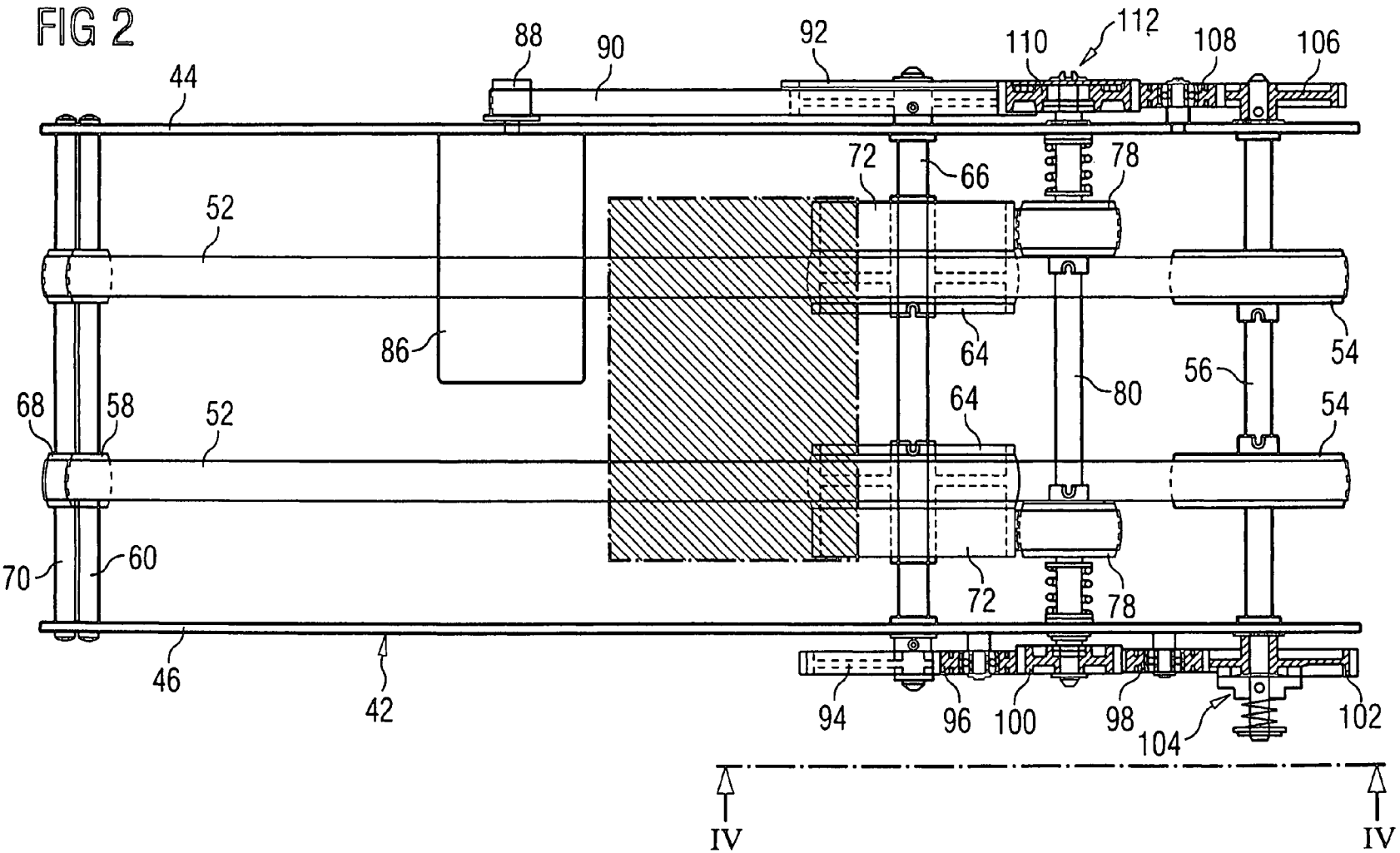
FIG. 2 shows a partly schematic plan view of a transporting unit, which forms the bundle-transporting section, as a bundle of aligned banknotes is transported in the direction of the dispensing compartment.
Figure 3:
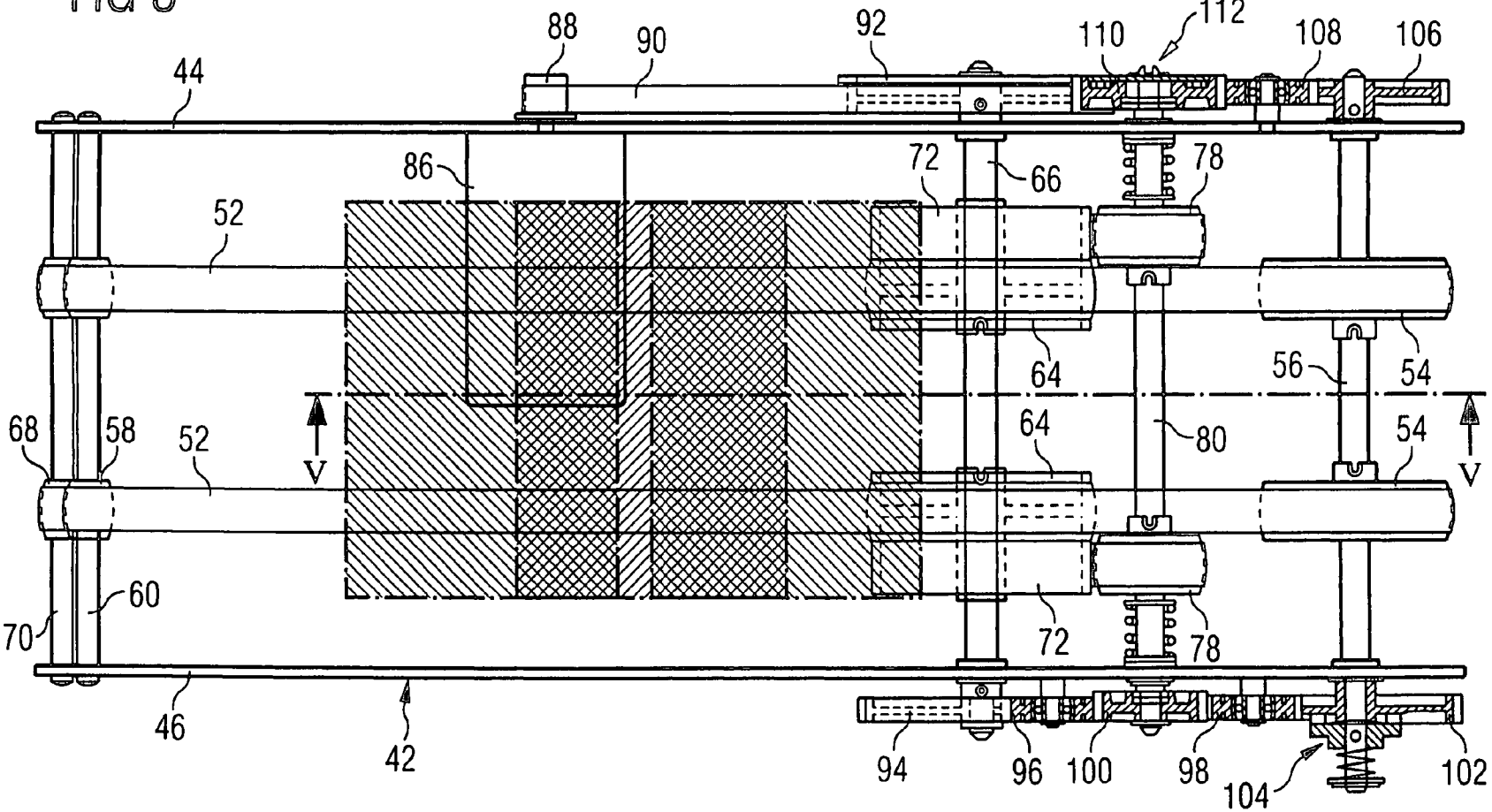
FIG. 3 shows a view corresponding to FIG. 2 as a bundle of banknotes is fanned out as it is transported in the opposite transporting direction.

For transporting in the forward direction, which is illustrated in FIGS. 2 and 4 and in the case of which a bundle of banknotes is to be transported, with the edges aligned, in the direction of the arrow A to the dispensing compartment 34 of the automated teller machine 10, the endless belts 52 of the top belt drive 48 and the endless belts 62 of the bottom belt drive 50 have to circulate at exactly the same speed. If in contrast, according to FIGS. 3 and 5, the bundle of banknotes is transported away from the dispensing compartment 34 in the direction of the reject cassette 18, then it is to be fanned out, according to the invention, by the endless belts 52 of the top belt drive 48 circulating, in the direction of the arrow B, at a higher speed than the endless belts 62 of the bottom belt drive 50.

The transmission ratios in the second gear train are selected such that the drive shaft 56 of the top belt drive 48 circulates at a higher speed than the drive shaft 66 of the bottom belt drive 50. In the first gear train, in contrast, the transmission ratios are selected such that the drive shafts 56 and 66 rotate at the same rotational speed. The one-way clutch 104, then, is designed such that when the bundle of banknotes returns, i.e. runs in the direction specified by the arrows B, the freewheel of the one-way clutch 104 takes effect, with the result that the drive shaft 56 of the top belt drive 48 is rotated at the higher rotational speed predetermined by the second gear train. In the forward direction, specified by the arrows A, in contrast, the one-way clutch 104 takes effect and ensures a torque-transmitting connection between the gearwheel 102 and the drive shaft 56. Since the rotational speed of the drive shaft 56 which is produced by the first gear train is lower than the rotational speed produced via the second gear train, there is braking of the drive shaft 56 by the one-way clutch 104 in forward-movement mode. The difference in rotational speed between the two gear trains is taken up by the slip clutch 112.

By virtue of the belt drives 48 and 50 circulating at different speeds, the individual banknotes of the bundle of banknotes are displaced in relation to one another in the running direction, i.e. the bundle is fanned out. The bundle as a whole thus becomes thinner and more flexible, with the result that it can be deflected more easily. This fanning-out can be enhanced by the drive direction being changed a number of times, as long as the bundle as a whole remains within the transporting section defined by the belt drives 48 and 50.

The invention claimed is:

1. An apparatus for transporting banknotes, within an automated teller machine, between at least one banknote cassette, for storing banknotes which are to be dispensed, and a dispensing location or between the latter and a receiving container for banknotes which have been drawn back, comprising a bundle-transporting section which is located between the dispensing location and a collecting location, at which banknotes which have been removed individually from the banknote cassette are collected into a bundle, and has first and second belt drives, a bundle of banknotes being gripped, and transported, between mutually parallel endless belts of the first and second belt drives, said endless belts circulating in the same direction in each case over a drive roller, and also has a drive arrangement for driving the first and second belt drives, wherein the first and second belt drives can be driven at different speeds at least in the direction from the dispensing location to the receiving container and wherein, the drive roller of a first belt drive and a parallel intermediate shaft of a third belt drive are coupled in a rotationally fixed manner to a motor.

2. The apparatus as claimed in claim 1, wherein the drive arrangement, for each belt drive, has a dedicated motor, of which at least one can be controlled in terms of speed.

3. The apparatus as claimed in claim 1, wherein the first and second belt drives can be driven by a common motor, and in that one of the first and second belt drives can be coupled to the motor in one transporting direction via a first gear train and in the other transporting direction via a second gear train with a different transmission from the first gear train.

4. The apparatus as claimed in claim 3, wherein the drive roller of the second belt drive is in torque-transmitting connection with the drive roller of the first belt drive via a first one-way clutch and with the intermediate shaft via a second one-way clutch, of which the direction of action is oriented counter to that of the first one-way clutch.

5. The apparatus as claimed in claim 4, wherein one of the one-way clutches is a latching freewheel.

6. The apparatus as claimed in claim 4, wherein one of the one-way clutches is a clamping-body freewheel.

7. The apparatus as claimed in claim 5, wherein the other one-way clutch is a slip clutch.

8. The apparatus as claimed in claim 4, wherein the two one-way clutches are vibratory-spring clutches which are controlled by friction clutches with a low torque.

9. The apparatus as claimed in claim 1, wherein the bundle-transporting section is coupled to a second transporting section comprising two belt drives, an endless belt of one belt drive being guided over the first drive roller and the endless belt of the second belt drive being guided over a drive roller which is seated on the intermediate shaft.

10. The apparatus as claimed in claim 9, wherein the second transporting section connects the bundle-transporting section to the collecting location and, via a diverter, to the receiving container.

* * * * *

UNITED STATES PATENT AND TRADEMARK OFFICE

CERTIFICATE OF CORRECTION

PATENT NO. : 7,121,459 B2
APPLICATION NO. : 10/466701
DATED : October 17, 2006
INVENTOR(S) : Holland-Letz It is certified that error appears in the above-identified patent and that said Letters Patent is hereby corrected as shown below:

On the Title Page (86)
IN THE FILING DATE (§ 371):
Delete "Jul. 18, 2001" and substitute --Jul. 18, 2003--.

Signed and Sealed this

Twenty-sixth Day of December, 2006

JON W. DUDAS
*Director of the United States Patent and Trademark Office*